US010964278B2

(12) United States Patent
Yabuki

(10) Patent No.: US 10,964,278 B2
(45) Date of Patent: Mar. 30, 2021

(54) DISPLAY APPARATUS

(71) Applicant: SAKAI DISPLAY PRODUCTS CORPORATION, Sakai (JP)

(72) Inventor: Haruhito Yabuki, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 0 days.

(21) Appl. No.: 16/488,480

(22) PCT Filed: Feb. 24, 2017

(86) PCT No.: PCT/JP2017/007188
§ 371 (c)(1),
(2) Date: Aug. 23, 2019

(87) PCT Pub. No.: WO2018/154728
PCT Pub. Date: Aug. 30, 2018

(65) Prior Publication Data
US 2020/0234662 A1 Jul. 23, 2020

(51) Int. Cl.
*G09G 3/36* (2006.01)

(52) U.S. Cl.
CPC ... *G09G 3/3607* (2013.01); *G09G 2320/0233* (2013.01); *G09G 2360/12* (2013.01)

(58) Field of Classification Search
CPC ..... G02F 1/133; G09G 2310/021; G09G 2310/027; G09G 2320/0209; G09G 2320/10; G09G 2360/16; G09G 3/20; G09G 3/36; G09G 3/3607; G09G 3/3648; G09G 3/3266; G09G 5/06; G09G 2320/0233; G09G 2360/12; G09G 3/3611
See application file for complete search history.

(56) References Cited

U.S. PATENT DOCUMENTS

2001/0024181 A1* 9/2001 Kubota ..... G09G 3/3611 345/87
2002/0067324 A1 6/2002 Aoki
(Continued)

FOREIGN PATENT DOCUMENTS

JP H09-508222 A 8/1997
JP 2002-229530 A 8/2002
(Continued)

OTHER PUBLICATIONS

International Search Report of PCT/JP2017/007188.

*Primary Examiner* — Richard J Hong
(74) *Attorney, Agent, or Firm* — ScienBiziP, P.C.

(57) ABSTRACT

A display apparatus comprises: pixels arranged in a matrix, gate lines, source lines, and a control unit. The gate lines are connected to pixels arranged in a row direction and select, in order, pixels in each row at a given frame period. The source lines supply a voltage according to a given gray scale to the pixels in the selected row. The control unit controls, based on gray scale data indicating gray scales included in one frame of video, a timing to cause the pixels in each row to display, in order, gray scales for one row in the video. The control unit corrects, with a target pixel as a reference, gray scale data indicating a gray scale to be displayed by the target pixel, based on an integrated value indicating an integration of voltage applied to a source line connected to the target pixel in one future frame.

10 Claims, 10 Drawing Sheets

(56) References Cited

U.S. PATENT DOCUMENTS

| | | | | |
|---|---|---|---|---|
| 2005/0156820 | A1 | 7/2005 | Aoki | |
| 2007/0222724 | A1* | 9/2007 | Ueno | G09G 5/06 345/87 |
| 2007/0279574 | A1* | 12/2007 | Minamizaki | G09G 3/3648 349/192 |
| 2009/0085856 | A1* | 4/2009 | Okada | G09G 3/3648 345/94 |
| 2009/0322720 | A1 | 12/2009 | Inoue | |
| 2010/0309192 | A1* | 12/2010 | Chao | G09G 3/3648 345/214 |
| 2011/0242148 | A1 | 10/2011 | Ina et al. | |
| 2012/0001951 | A1* | 1/2012 | Katagawa | G09G 3/3648 345/690 |
| 2013/0076769 | A1* | 3/2013 | Park | G09G 3/3648 345/547 |
| 2014/0375697 | A1* | 12/2014 | Hakoda | G09G 3/3648 345/690 |
| 2016/0196793 | A1* | 7/2016 | Xu | G09G 3/3611 345/694 |
| 2018/0122311 | A1 | 5/2018 | Mori et al. | |
| 2019/0333445 | A1* | 10/2019 | Kurokawa | G09G 3/3266 |

FOREIGN PATENT DOCUMENTS

| | | | |
|---|---|---|---|
| JP | 2005-202159 | A | 7/2005 |
| JP | 2006-023710 | A | 1/2006 |
| JP | 2008-040125 | A | 2/2008 |
| JP | 2008-058345 | A | 3/2008 |
| WO | 96/16393 | A1 | 5/1996 |
| WO | 2008/062577 | A1 | 5/2008 |
| WO | 2010/079641 | A1 | 7/2010 |
| WO | 2016/171069 | A1 | 10/2016 |

* cited by examiner

DISPLAY APPARATUS

TECHNICAL FIELD

The present invention relates to a display apparatus, for example, a liquid-crystal display apparatus.

BACKGROUND ART

A phenomenon called a vertical shadow is known as one of phenomena that degrade the image quality of video displayed on a liquid-crystal display apparatus.

Patent Document 1 discloses an active-matrix type display apparatus aimed at preventing a vertical shadow. In the display apparatus in Patent Document 1, given data is determined based on data for each column that are included in input image data and, based on the determined data, voltage driving of a data signal line (a source line) to which a display element (a pixel) is connected is carried out within a vertical blanking period after the valid period of image displaying using the above-mentioned image data. This adjusts a voltage held at each display element collectively within the vertical blanking period after the image data is supplied and suppresses the vertical shadow.

PRIOR ART DOCUMENT

Patent Document

Patent Document 1: JP 2008-058345 A

SUMMARY OF THE INVENTION

Problem to be Solved by the Invention

The vertical shadow is produced due to a Csd parasitic capacitance between a source line and a pixel in a display apparatus. The Csd parasitic capacitance also brings about problems such as gray scale inclination in a video displayed on the display apparatus.

An object of the present invention is to provide a display apparatus which can suppress an effect of a Csd parasitic capacitance when a video is displayed on the display apparatus.

Means to Solve the Problem

A display apparatus according to the present invention comprises: a plurality of pixels, a plurality of gate lines, a plurality of source lines, and a control unit. The plurality of pixels is arranged in a matrix. The plurality of gate lines is connected to a group of pixels lined up in a row direction of the matrix of pixels and select, in order, a group of pixels in each row at a given frame period. The plurality of source lines is connected to a group of pixels lined up in a column direction of the matrix of pixels and supply a voltage according to a given gray scale to a group of pixels in the selected row. The control unit controls, based on gray scale data indicating gray scales included in one frame of video, a timing to cause a group of pixels in each row to display, in order, gray scale for one row in the video. The control unit corrects, with a target pixel for display as a reference, gray scale data indicating a gray scale to be displayed by the target pixel, based on an integrated value indicating an integration of voltage applied to a source line connected to the target pixel in a period corresponding to one frame in future time or a sum of gray scale data indicating gray scales to be displayed by other pixels connected to the same source line as the target pixel in a period corresponding to one frame in future time.

Effect of the Invention

According to the display apparatus of the present invention, with a target pixel for display as a reference, gray scale data for the pixel is corrected in accordance with, for example, integration of a voltage of a source line in a period corresponding to one frame in future time. This makes it possible to suppress an effect of a Csd parasitic capacitance when a video is displayed on the display apparatus.

EMBODIMENTS FOR CARRYING OUT THE INVENTION

Figure 1:
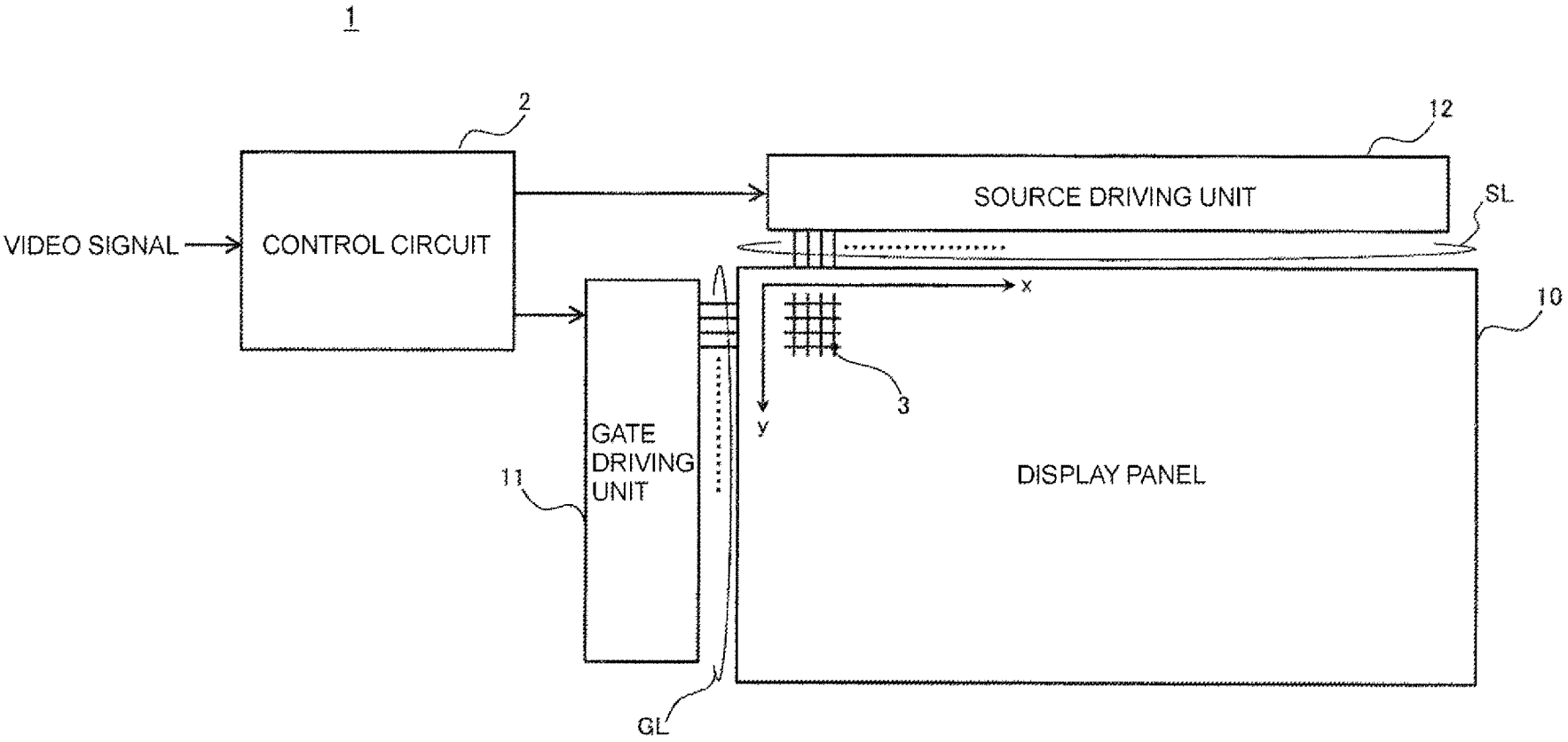
FIG. 1 shows a configuration of a display apparatus according to Embodiment 1 of the present invention.

Below a display apparatus according to embodiments of the present invention is described with reference to the drawings. In each embodiment below, the same reference numerals are affixed to the same constituting elements.

Embodiment 1

1. Configuration

A configuration of a display apparatus according to Embodiment 1 is described below.

The configuration of the display apparatus according to Embodiment 1 is described using FIG. 1. FIG. 1 shows the configuration of a display apparatus 1 according to Embodiment 1 of the present invention.

The display apparatus 1 according to the present embodiment makes up a liquid-crystal display apparatus such as a liquid-crystal television, for example. As shown in FIG. 1, the display apparatus 1 comprises a display panel 10, a gate driving unit 11, a source driving unit 12, and a control circuit 2.

The display panel 10 is an active-matrix type liquid-crystal panel having a given specification such as 8K, 4K, or 2K, for example. As shown in FIG. 1, the display panel 10 comprises a plurality of pixels 3, a plurality of gate lines GL, and a plurality of source lines SL. Moreover, the display panel 10 comprises a TFT (thin-film transistor) substrate comprising a pixel electrode, a CF (color filter) substrate comprising a counter electrode, a liquid-crystal layer sealed in between both of the substrates, and a polarizing plate, for example.

The display panel 10 displays a gray scale for each one of the pixels 3, for example, a gray scale for one color of R, G, and B. In the display panel 10, the plurality of pixels 3 are arranged in a matrix. Below, the row direction of the matrix of pixels 3 is called "the horizontal direction", and shown with a horizontal coordinate x. Moreover, the column direction of the matrix of pixels 3 is called "the vertical direction", and shown with a vertical coordinate y. Furthermore, the positive side in the vertical direction can be called a lower side, while the negative side therein can be called an upper side.

The plurality of pixels 3 comprise a TFT being an active element. In the TFT at each of the pixels 3, a gate is connected to a gate line GL, while a source is connected to a source line SL (see FIG. 2). Details of a configuration of the pixel 3 will be described later.

Each of the gate lines GL extends in the horizontal direction of the display panel 10 and is connected to pixels 3 in one row in the matrix of the pixels 3. The plurality of gate line GL is arranged such that they are lined up in the vertical direction of the display panel 10 in correspondence with the vertical coordinate y of the pixel 3 to which each is connected. The gate line GL is a signal line for selecting a group of pixels having a common vertical coordinate y.

Each of the source lines SL extends in the vertical direction of the display panel 10 and is connected to pixels 3 in one column in the matrix of the pixels 3. The plurality of source lines SL is arranged such that they are lined up in the horizontal direction of the display panel 10 in correspondence with the horizontal coordinate x of the pixel 3 to which each is connected. The source line SL is a signal line for supplying a given voltage, in order, to a group of pixels having a common horizontal coordinate x.

The gate driving unit 11 comprises an IC to which the plurality of gate lines GL are connected. The gate driving unit 11 supplies, to the gate lines GL, a signal for selecting, in order, a group of pixels in one row corresponding to each vertical coordinate y with a given frame period (for example, 1/60 seconds) in accordance with control of the control circuit 2.

The source driving unit 12 comprises an IC to which the plurality of source lines SL are connected. The source driving unit 12 supplies, via the source lines SL, a voltage according to a gray scale to be displayed to a group of pixels in the selected row in synchronization with an operation of the gate driving unit 11, in accordance with control of the control circuit 2.

The control circuit 2 comprises one or more semiconductor integrated circuits such as an LSI, for example. The control circuit 2, as a timing controller, generates various signals for controlling an operational timing of each unit of the display apparatus 1. The control circuit 2 can control an overall operation of the display apparatus 1.

For example, the control circuit 2 generates control signals for the gate driving unit 11 and the source driving unit 12 based on a video signal input externally so as to cause the group of pixels in each row to display, in order, gray scales for one row in a video indicated frame-by-frame by the video signal. Moreover, the control circuit 2 performs given video signal processing in addition to control of operational timings of the gate driving unit 11 and the source driving unit 12 as such. Details of a configuration of the control circuit 2 will be described later.

1-1. Pixel Structure of Display Panel

Figure 2:
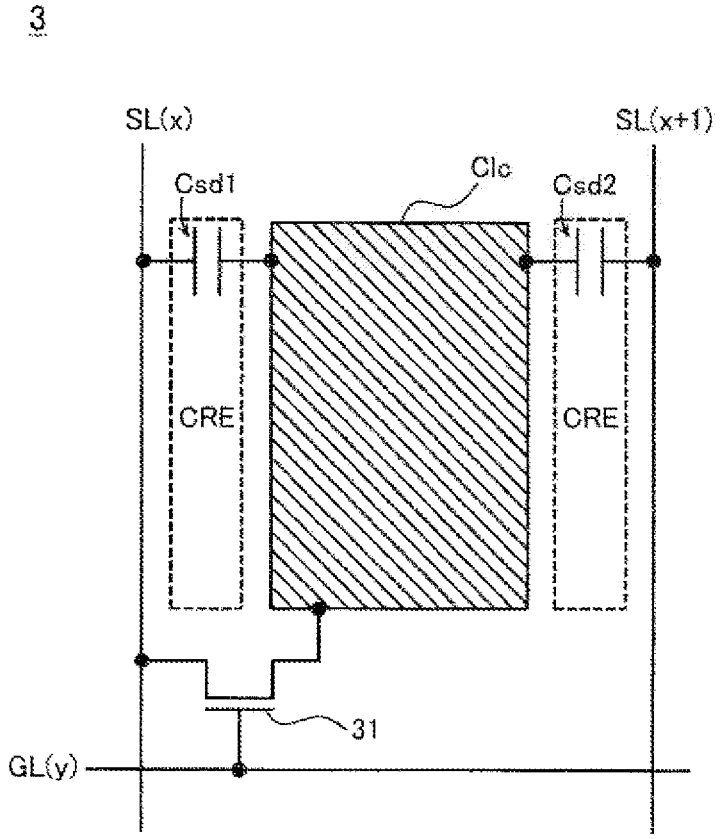
FIG. 2 shows a configuration of a pixel in a display panel of a display apparatus.

Details of a configuration of the pixel 3 in the display panel 10 of the display apparatus 1 are described with reference to FIG. 2. FIG. 2 shows a configuration of the pixel 3 in the display panel 10 of the display apparatus 1.

FIG. 2 shows a configuration of the pixel 3 having specific coordinates (x, y) on the display panel 10. In the RGB panel of the 4K or 2K specification, for example, the horizontal coordinate x of the pixel 3 is within the range of 1 to 11520 (=3840×3), where the vertical coordinate y is within the range of 1 to 2160.

As shown in FIG. 2, the pixel 3 comprises a TFT 31 and a liquid-crystal capacitance Clc. In the TFT 31 of the pixel 3 of the coordinates (x, y), the gate is connected to a gate line GL (y) corresponding to the vertical coordinate y, the source is connected to a source line SL (x) corresponding to the horizontal coordinate x, and the drain is connected to one end (a pixel electrode) of the liquid-crystal capacitance Clc. The other end of the liquid-crystal capacitance Clc is connected to a counter electrode in the display panel 10, for example.

The TFT 31 turns on when a voltage applied to the gate based on a signal from the gate line GL (y) is no less than a given threshold voltage and turns off when the voltage applied to the gate is less than the given threshold voltage. The threshold voltage of the TFT 31 is between 2 and 3 volts, for example. The TFT 31 is one example of an active element connected to the gate line GL (y).

The liquid-crystal capacitance Clc comprises a pixel electrode, a counter electrode, and a liquid-crystal layer and changes an aligned state of the liquid-crystal layer in accordance with a voltage charged. The liquid-crystal capacitance Clc charges or discharges electrical charges based on the voltage of a signal input from the source signal line SL during the period in which the TFT 31 is on. The liquid-crystal capacitance Clc holds the charged voltage obtained by charging/discharging before the TFT 31 changes to an off state.

As shown in FIG. 2, the pixel 3 has a parasitic capacitance Csd1 between the pixel electrode and the source line SL (x) to which the pixel 3 is connected, or, in other words, between the drain and the source of the TFT 31. Moreover, the pixel 3 has a parasitic capacitance Csd2 between the pixel electrode and a neighboring source line SL (x+1). The capacitances Csd are respectively an example of the Csd parasitic capacitance between the pixel 3 and the source line SL (x) and an example of the Csd parasitic capacitance between the pixel 3 and the source line SL (x+1). To reduce the capacitance value of such Csd parasitic capacitances, a CRE (capacity reduction electrode) structure can be provided at the pixel 3.

With the pixel 3 configured as described above, when a voltage no less than the threshold voltage of the TFT 31 is applied from the gate line GL (y), charging/discharging of the liquid-crystal capacitance Clc is made possible, so that the pixel 3 is selected. In accordance with the voltage of a signal input to the selected pixel 3 from the source line SL (x), a charging voltage for displaying a gray scale of a pixel corresponding in the video is charged/discharged.

1-2. Configuration of Control Circuit

Figure 3:
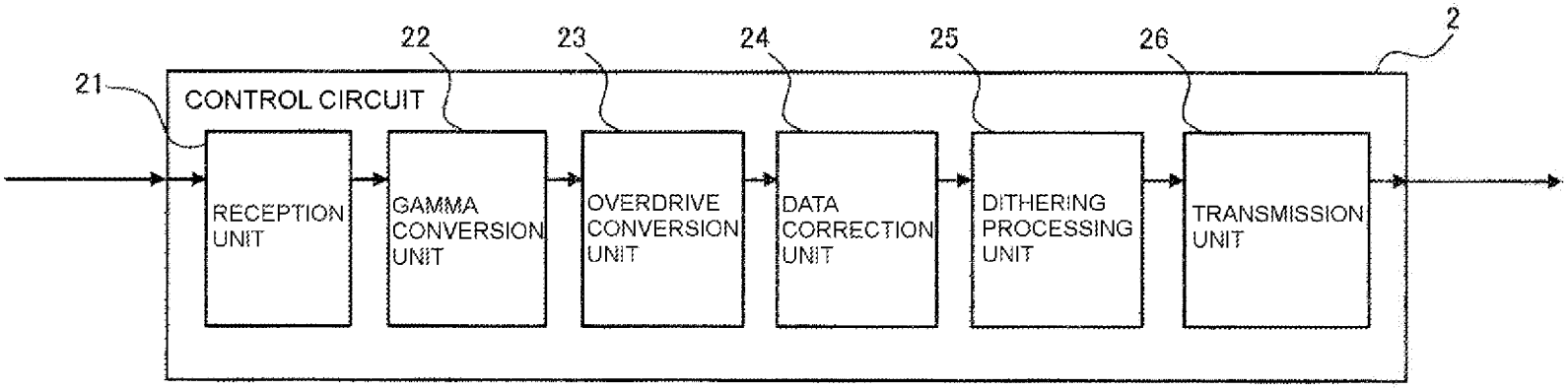
FIG. 3 shows a block diagram of a configuration of a control circuit in a display apparatus.

Details of the configuration of the control circuit 2 are described with reference to FIG. 3. FIG. 3 is a block diagram showing the configuration of the control circuit 2 in the display apparatus 1.

As shown in FIG. 3, the control circuit 2 comprises a reception unit 21, a gamma conversion unit 22, an overdrive conversion unit 23, a data correction unit 24, a dithering processing 25, and a transmission unit 26. The control circuit 2 is one example of a control unit in the display apparatus 1 according to the present embodiment.

The reception unit 21 is an input interface circuit according to given communication standards. The reception unit 21 receives video signals input externally. The external video signals include video data indicating a video for each frame, and various synchronization signals.

The gamma conversion unit 22 executes a gamma conversion process in which a gamma correction is performed on video data in the video signals received.

The overdrive conversion unit 23 performs an overdrive conversion process on the video data after the gamma conversion process is performed, for example. The overdrive conversion process is a process in which a conversion is performed on the present video data with reference to the previous video data to perform an overshoot drive on the pixel 3 of the display panel 10.

The data correction unit 24 performs a computational correction (a Csd correction) on video data after the overdrive conversion process is performed, for example, for suppressing an effect of the Csd parasitic capacitance in the display panel 10. The configuration of the data correction unit 24 according to the present embodiment is to be described later.

The dithering processing unit 25 performs a dithering process in which dithering is performed on the video data corrected by the data correction unit 24 in accordance with the number of colors which can be developed in the display panel 10.

The transmission unit 26 is an output interface circuit according to given communication standards. The transmission unit 26 transmits video data resulting from various processes described above to the source driving unit 12 of the display panel 10. Moreover, the transmission unit 26 also outputs a control signal for the source driving unit 12, a control signal for the gate driving unit 11, and a synchronization signal for synchronizing operational timings of the respective units.

The control circuit 2 can be a hardware circuit such as a reconfigurable electronic circuit or a dedicated electronic circuit designed to realize given functions such as the gamma conversion unit 22, the overdrive conversion unit 23 and the data correction unit 24. Moreover, the control circuit 2 can comprise a CPU which realize various functions as described above in cooperation with software. The control circuit 2 can be constituted by various integrated circuits such as an ASIC, an FPGA, a DSP, a microcomputer, an MPU, and a CPU.

1-3. Data Correction Unit

A configuration of the data correction unit 24 according to the present embodiment is described with reference to FIGS. 4 and 5.

Figure 4:
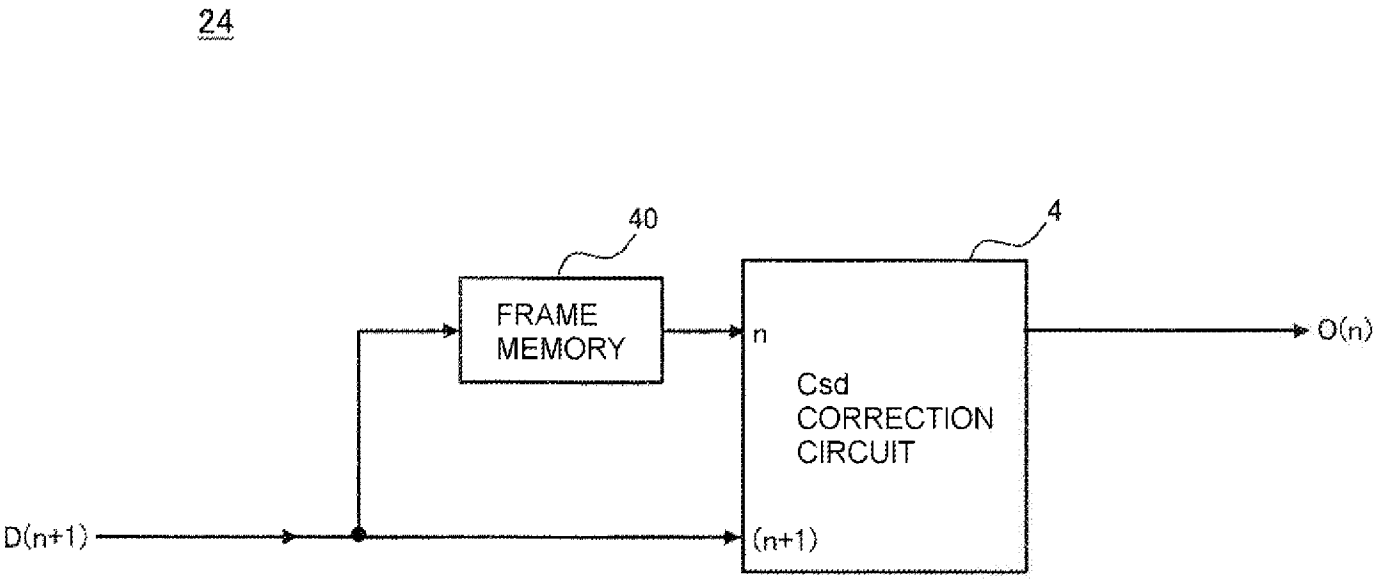
FIG. 4 shows a block diagram of a configuration of a data correction unit according to Embodiment 1.

FIG. 4 shows a block diagram of the configuration of the data correction unit 24 according to the present embodiment. As shown in FIG. 4, the data correction unit 24 comprises a frame memory 40 and a Csd correction circuit 4.

In the present embodiment, in the data correction unit 24, video data D (n) that is passed through a frame memory 40 and delayed by one frame to be input to the Csd correction circuit 4 is handled as current video data. Moreover, video data D (n+1) that is input to the Csd correction circuit 4 without passing through the frame memory 40 is referred to as future video data relatively by one frame.

In the present embodiment, the frame memory 40 stores video data D (n) for one frame without specifically compressing them. In this way, computational correction in the data correction unit 24 can be performed without impairing the display quality of the video data D (n) to be handled as the current frame (the present frame).

The Csd correction circuit 4 reads out video data D for the present frame from the frame memory 40 and executes a computational correction on the video data D (n) for the present frame referring to the video data D (n+1) for the following frame. In this way, the data correction unit 24 outputs corrected video data O(n) for the present frame from the Csd correction circuit 4. FIG. 5 shows an exemplary configuration of the Csd correction circuit 4 according to the present embodiment.

Figure 5:
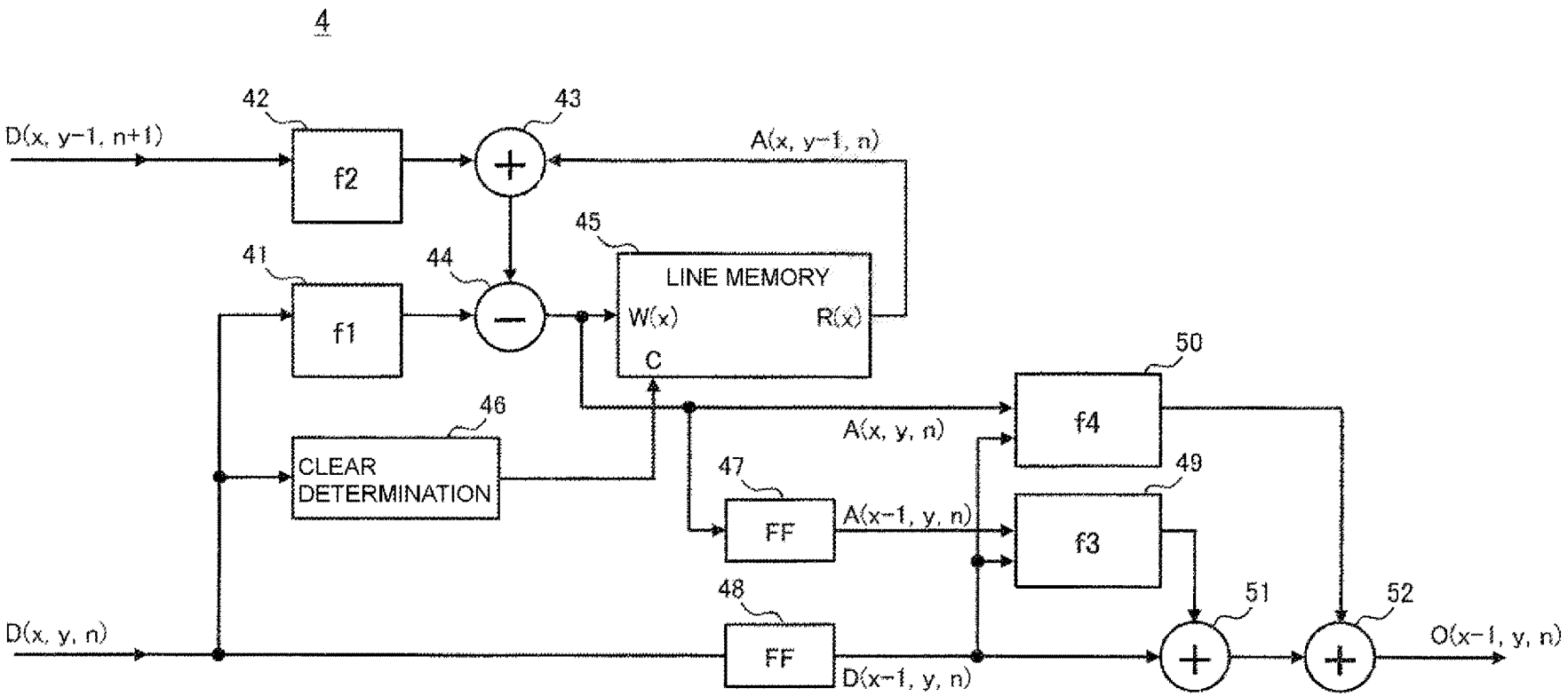
FIG. 5 shows a block diagram of an exemplary configuration of a Csd correction circuit according to Embodiment 1.

The Csd correction circuit 4 exemplified in FIG. 5 comprises coefficient multiplying units 41 and 42, adders 43, 51, 52, a subtractor 44, a line memory 45, a clear determination unit 46, flip-flops 47 and 48, and function computation units 49 and 50.

The Csd correction unit 4 inputs one frame of video data D (n) for each gray scale data D (x, y, n). The gray scale data D (x, y, n) is data indicating a gray scale for each pixel in a video indicated by the video data D (n) and defines a voltage supplied to the pixel 3 of the corresponding coordinates (x, y) on the display panel 10. For the gray scale data D (x, y, n), positive and negative values (whose absolute value is a gray scale value) can be set in accordance with a driving technique such as frame inversion. Moreover, the gray scale data D (x, y, n) define a voltage of a source line SL (x) within a vertical blanking period (described later), for example, thus, the gray scale data D (x, y, n) can have a vertical coordinate y corresponding to the exterior of the display panel 10 (see FIG. 7).

The Csd correction circuit 4 inputs each gray scale data D (x, y, n) such that a two-dimensional scanning is performed with the horizontal direction (x) as a main scanning direction and the vertical direction (y) as a sub-scanning direction in a given number of gray scale data {D (x, y, n)} included in one frame of video data D (n). Moreover, the Csd correction circuit 4 inputs present frame gray scale data D (x, y, n) and following frame gray scale data D (x, y, n+1) in synchronization in accordance with a given synchronization signal.

The coefficient multiplying units 41 and 42 comprise LUTs for calculating the below-described coefficients f1 and f2 (or values in which gray scale data are multiplied by coefficients f1 and f2). The coefficient multiplying unit 41 outputs a multiplied value f1·D (x, y, n) with reference to the LUT based on the present frame gray scale data D (x, y, n). Similarly, the coefficient multiplying unit 42 outputs a multiplied value f2·D (x, y, n+1) based on the following frame gray scale data D (x, y, n+1). For example, each of the coefficient multiplying units 41 and 42 outputs a multiplied value "0" based on an input value "0".

The adder 43 adds the multiplied value f2·D (x, y, n+1) of the coefficient multiplying unit 42 to a read-out value R(x) from the line memory 45. The subtractor 44 subtracts the multiplied value f1·D (x, y, n) of the coefficient multiplying unit 41 from the output value of the adder 43. The computed result (the output value of the subtractor 44) corresponds to the below-described integrated value A (x, y, n). The Csd correction circuit 4 writes the computationally-resulting integrated value A (x, y, n) into the line memory 45 as a written value W (x).

The line memory 45 stores the written values {W (x)|x=1 to X} (where X is the maximum value of the horizontal coordinate X) corresponding to one row in the horizontal direction of the pixel 3 in the display panel 10. Each written value W (x) is read out as a read-out value accordingly. The clear determination unit 46 generates a clear signal for erasing information stored in the line memory 45 based on a trigger signal at the time of, for example, activating power supply.

The flip-flop 47 holds the computationally-resulting integrated value A (x, y, n). The flip-flop 48 holds the present frame gray scale data D (x, y, n). Each of the flip-flops 47 and 48 delays each data by one operation period (corresponding to the difference "1" in the horizontal coordinate x).

The function computation units 49 and 50 comprise LUTs for calculating the below-described functions f3 and f4. The function computation units 49 output a computed value of the function f3 based on the respectively delayed gray scale data D (x−1, y, n) and integrated value A (x−1, y, n). A function computation unit 50 outputs a computed value of the function f4 based on the delayed gray scale data D (x−1, y, n) and the non-delayed integrated value A (x, y, n). Each of the function computation units 49 and 50 is configured to set the computed value of the functions f3 and f4 to be "0" when each input data is "0", for example.

The adders 51 and 52 add the computed value for the function f3 and the computed value for the function f4 to the delayed gray scale data D (x−1, y, n) and outputs gray scale data O (x−1, y, n) after correcting on the above-mentioned gray scale data D (x−1, y, n).

According to the Csd correction circuit 4 configured as described above, calculation of the below-described Equations (2) to (5) is executed and computational correction of the gray scale data D (x, y, n) is realized.

2. Operation

Operation of the display apparatus 1 configured as described above is described below.

2-1. Vertical Shadow

Figure 6:
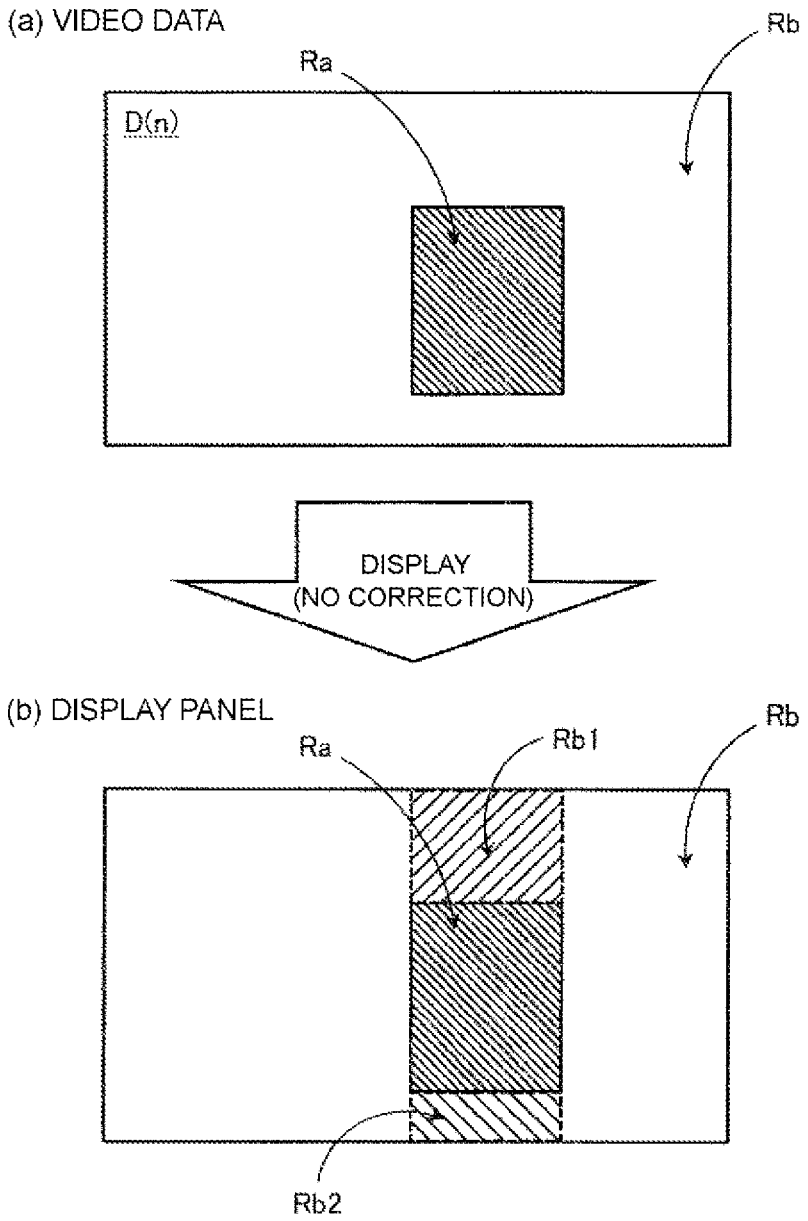
FIG. 6 is a drawing for explaining a vertical shadow in a display panel.

First, a vertical shadow which can occur in the display apparatus is described with reference to FIG. 6. FIG. 6 is a drawing for explaining a vertical shadow in a display panel.

FIG. 6 (*a*) exemplifies one frame of video data D (n). FIG. 6 (*b*) shows an exemplary display of the display panel when a vertical shadow occurs in a video display based on the video data D (n) in FIG. 6 (*a*).

The video data D (n) in FIG. 6 (*a*) comprise a background region Rb having a given gray scale and an object region Ra surrounded by the background region Rb. The object region Ra has a gray scale different from the gray scale of the background region Rb. When such video data D (n) are input to the display panel, regions Rb1 and Rb2 having a gray scale (or color) deviating from the background region Rb, in other words, "vertical shadow", can appear on the upper and lower sides in the vertical direction of the object region Ra, as shown in FIG. 6 (*b*).

The above-described vertical shadows can be produced due to the Csd parasitic capacitance between the source line SL and the pixel 3 as the pixels 3 within the regions Rb1 and Rb2 (FIG. 1) and the pixels 3 in the object region Ra are each connected to the same source line SL. When each pixel 3 is provided with a CRE structure so as to make the capacitance value of the parasitic capacitances Csd1 and Csd2 (FIG. 2) sufficiently small to suppress the vertical shadows, for example, the transmittance of the pixel 3 can decrease and the image quality of the video can degrade. For example, in a case of an 8K-specification display panel, it is considered that the size of the pixel 3 be small and a decrease in the transmittance be a serious problem.

Thus, in the present embodiment, a computation correction (in other words, a Csd correction) is performed in the data correction unit 24 in the control circuit 2 of the display apparatus 1 so as to suppress an effect of the Csd parasitic capacitance. Below details of an operation of the display apparatus 1 according to the present embodiment is described.

2-2. Csd Correction

Figure 7:
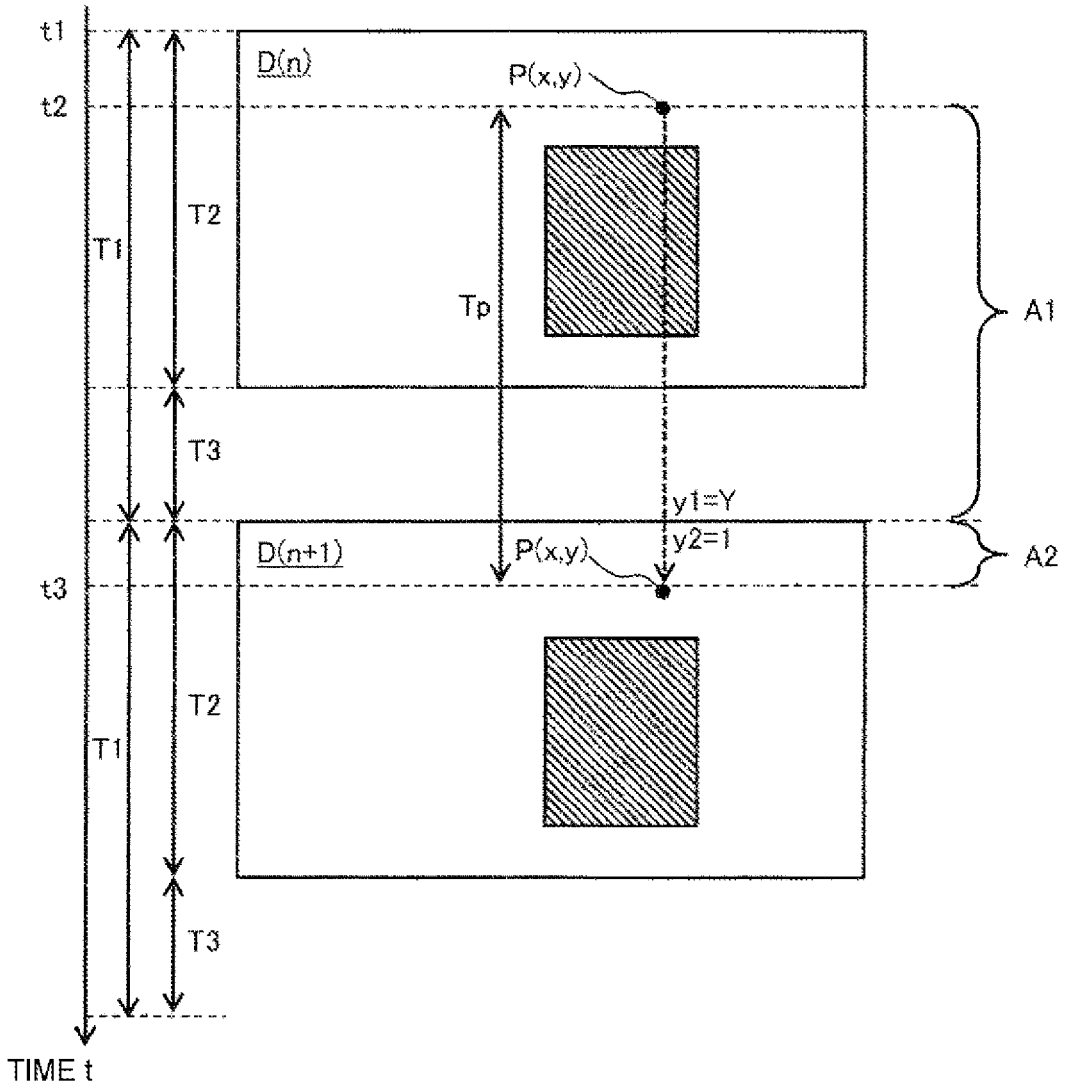
FIG. 7 is a drawing for explaining a technique for computing Csd correction by the data correction unit.

A technique for computing Csd correction by the data correction unit 24 of the display apparatus 1 according to the present embodiment is described using FIG. 7. FIG. 7 is a drawing for explaining a technique for computing Csd correction by the data correction unit 24.

FIG. 7 exemplifies operational timings of video display in the display apparatus 1 for two consecutive frames of video data D(n) and D(n+1). As shown in FIG. 7, a frame period T1 for displaying one frame of video comprises a vertical display period T2 and a vertical blanking period T3.

The vertical display period T2 is a period in which pixel group in every row in the display panel 10 (FIG. 1) are selected to display one frame of video. The vertical blanking period T3 is a period in which a given interval is provided between the end of the vertical display period T2 of the present frame and the start of the next frame. For example, the vertical display period T2 includes 2160 rows of period of charging one row of pixel group. The vertical display period T3 corresponds to 90 rows of charging period, for example.

The display apparatus 1 starts display of video with the n-th frame video data D (n) at time t1 in the example in FIG. 7 in accordance with control of the control circuit 2 (FIG. 1). In the vertical display period T2 from time t1, the control circuit 2 causes (liquid-crystal capacitances Clc of) pixels 3 in each corresponding row to be charged, in order from y=1, based on gray scale data D (1, y, n) to D (X, y, n) for each row in the n-th frame video data D (n). Each pixel 3 holds a charging voltage according to the gray scale data D (x, y, n) to display a gray scale indicated by the gray scale data D (x, y, n).

For example, the pixel 3 of a point P(x, y) having coordinates (x, y) in the display panel 10 (FIG. 1) is charged based on the gray scale data D (x, y, n) corresponding in the n-th frame video data D (n) at time t2 within the vertical display period T2 from time t1. The pixel 3 of the charged point P (x, y) holds a charging voltage such that a gray scale indicated by the n-th frame gray scale data D (x, y, n) is displayed during a period Tp corresponding to one frame to time t3 at which charging using the following (n+1) frame gray scale data D (x, y, n+1) is performed.

In the above-described period Tp, voltages are applied, in order, to the source line SL to which the pixel 3 at the point P (x, y) is connected. The voltages are based on a gray scale data for corresponding column in n-th frame video data D (n) or (n+1)-th frame video data D (n+1). At this time, parasitic capacitances Csd1 and Csd2 (FIG. 2) between the pixel 3 at the point P (x, y) and the above-mentioned source line SL (x) and neighboring source line SL (x+1) can change the charging voltage of the this pixel 3 in dependence on a voltage applied to each of the source lines SL (x) and SL (x+1).

In light of the above, the present inventors considered that an effect of the Csd parasitic capacitance on the charging voltage of the pixel 3 can be estimated by an integration of a voltage to be applied to a corresponding source line SL (x) during the period Tp in accordance with gray scale data D (x, y, n) for each column. Thus, in the present embodiment, an integrated value (A (x, y, n)) indicating an integration of voltages to be applied, in order, to a common source line SL (x) during the period Tp corresponding to one frame in future time on or after the present time is determined and used for Csd correction on the gray scale data D (x, y, n) at the present time.

2-2-1. Theoretical Equation of Integrated Value

Below a theoretical Equation (1) of the integrated value A (x, y, n) adopted in the present embodiment is shown.

[Mathematical expression 1]

$$A(x, y, n) = \underbrace{\sum_{y_1=y+1}^{Y} f_1 \cdot D(x, y_1, n)}_{A1} + \underbrace{\sum_{y_2=1}^{y-1} f_2 \cdot D(x, y_2, n+1)}_{A2} \quad (1)$$

Here, the point P (x, y) in FIG. 7 corresponds to the time for which the integrated value A (x, y, n) is to be computed. As shown in the above Equation (1), the integrated value A (x, y, n) is determined by integrating gray scale data D (x, y+1, n) to D (x, y−1, n+1), for one frame, having the common horizontal coordinate x as the point P (x, y) in two consecutive frames.

In the Equation (1), a first term A1 shows an integrated amount of voltages applied to the source line SL (x) after charging the pixel 3 of the point P(x, y) in the present frame (n frame). Integration of the first term A1 is computed by weighted addition in which a coefficient f1 is multiplied to gray scale data {D (x, y1, n)|y1=y+1 to Y} within a range larger than the vertical coordinate y of the point P (x, y) to compute a sum. The upper limit sum value Y corresponds to the end of the vertical blanking period T3 and Y=2250 (=2160+90), for example. The coefficient f1 is a function of the coordinates (x, y) and/or the coordinates (x, y1) of the point P (x, y), for example, and shows dispersion within the display surface of the display panel 10. The coefficient f1 includes a component for converting gray scale data into voltage.

A second term A2 shows an integrated amount of voltages applied to the source line SL (x) before the start of charging the pixel 3 of the point P(x, y) in the following frame ((n+1) frame). Integration of the second term A2 is computed by weighted addition based on a coefficient f2 on gray scale data {D (x, y2, n+1)|y2=1 to y−1} within a range smaller than the vertical coordinate y of the point P (x, y). The second coefficient f2 is the same function as the first coefficient f1, for example.

For example, for the integrated value A (x, 1, n) when y=1, the pixel 3 of the point P (x, y) is charged at the start of the following frame, resulting in A2=0, and the integrated value A (x, 1, n) is calculated by the first term A1. Similarly, for the integrated value A (x, Y, n) when y=Y, the integrated value A (x, Y, n) is calculated by the second term A2 since A1=0. It is considered that during charging of the pixel 3 itself of the point p (x, y), this pixel 3 be not affected by the Csd parasitic capacitance, so that, in the integrated value A (x, y, n) in Equation (1), the gray scale data D (x, y, n) of the point P (x, y) is not included in what is to be integrated.

2-2-2. Computation Equation of Csd Correction

Using the above-described integrated value A (x, y, n), the data correction unit 24 of the display apparatus 1 according to the present embodiment performs computational correction on the gray scale data D (x, y, n) for each pixel 3. The computation equation of the Csd correction by the data correction unit 24 is shown below.

[Mathematical expression 2]

$$O(x, y, n) = D(x, y, n) + \Delta D(x, y, n) \quad (2)$$

$$\Delta D(x, y, n) = f_3\left(D(x, y, n), \frac{A(x, y, n)}{Y-1}\right) + f_4\left(D(x, y, n), \frac{A(x+1, y, n)}{Y-1}\right) \quad (3)$$

$$A(x, y, n) = A(x, y-1, n) - f_1 \cdot D(x, y, n) + f_2 \cdot D(x, y-1, n+1) \quad (4)$$

$$A(x, 1, n) = A(x, Y, n-1) - f_1 \cdot D(x, 1, n) + f_2 \cdot D(x, Y, n) \quad (5)$$

As shown in Equation (2), the gray scale data O (x, y, n) after correction is determined by adding a correction amount ΔD (x, y, n) to the gray scale data D (x, y, n) (before correction). Equation (3) is an equation for calculating a correction amount ΔD (x, y, n) based on the above-described integrated value A (x, y, n). The correction amount ΔD (x, y, n) on the gray scale data D (x, y, n) of the point P (x, y) is calculated as a sum of the first term and the second term in the right side of the Equation (3).

The first term of Equation (3) is expressed by a function f3 having, as arguments of the function f3, the gray scale data D (x, y, n) of the point P (x, y) and an effective value A (x, y, n)/(Y−1) of the integrated value A (x, y, n) of the point P (x, y). The function f3 is set in accordance with the ratio between the liquid-crystal capacitance Clc and the parasitic capacitance Csd1 of the pixel 3 to correct an effect of the parasitic capacitance Csd1 (FIG. 2) by the source line SL (x) connected to the pixel 3 itself of the point P (x, y). The function f3 includes a component for converting voltage into gray scale data.

The second term of the Equation (3) is expressed by a function f4 having, as arguments of the function f4, a gray scale value of the gray scale data D (x, y, n) of the point p (x, y), and an effective value A (x+1, y, n)/(Y−1) of the integrated value A (x+1, y, n) of a neighboring point P' (x+1, y) of the point P(x, y). The function f4 is set in accordance with the ratio between the liquid-crystal capacitance Clc and the parasitic capacitance Csd2 of the pixel 3 to correct an effect of the parasitic capacitance Csd2 by the source line SL (x+1) adjacent to the pixel 3 of the point P (x, y). The function f4 includes a component for converting voltage into gray scale data.

The functions f3 and f4 of the first and second terms of Equation (3) are independently set so as to correct an effect by each of separate parasitic capacitances Csd1 and Csd2. Each of the functions f3 and f4 can be a function dependent on the coordinates (x, y), taking into account dispersion within the display surface of the display panel 10.

Moreover, for the liquid-crystal capacitance Clc in the pixel 3, a capacitance value changes depending on the charging voltage, so that each of the functions f3 and f4 depends on the gray scale data D (x, y, n) defining the charging voltage of the liquid-crystal capacitance Clc.

Moreover, an effect of the Csd parasitic capacitance changes when the length of the vertical blanking period T3 is different even when videos displayed in the vertical display period T2 are identical. Thus, taking into account the effect due to the length of the vertical blanking period T3, the effective value A (x, y1, t)/(Y−1) in which the integrated value A (x, y1, t) is divided by (Y−1) is used as an argument of the functions f3 and f4. In this way, even when the length (a value of Y) of the vertical blanking period T3 differs between the video signal in 60 Hz system and the video signal in 50 Hz system, for example, an effect of the Csd parasitic capacitance can similarly be corrected substantially.

When the correction amount ΔD (x, y, n) as described above is determined for each pixel 3, an integrated value A (x, y, n) is calculated using a recursion formula as shown in Equations (4) and (5) in the present embodiment. Below recursion formulas for the integrated value A (x, y, n) are described.

2-2-3. Recursion Formula for Integrated Value

In the present embodiment, the data correction unit 24 calculates integrated values A (x, y, n) for one frame in future time from the time of charging for each pixel 3 and corrects, in order, the gray scale data D (x, y, n) of each pixel 3. At this time, the circuit size can be enormous with a computational technique such that computation to calculate a sum of gray scale data D (x, y+1, n) to gray scale data D (x, y−1, n+1) for one row as in the theoretical Equation (1) is executed independently for all pixels 3. Thus, in the present embodiment, a recursion formula as shown in Equation (4) or (5) is adopted to determine each integrated value A (x, y).

Equation (4) is an equation in which Equation (1) is equivalently deformed into a recursion formula form when y>1. Equation (5) is an equation in which Equation (1) is equivalently deformed in the same manner as Equation (4) when y=1. When Equation (4) or (5) is adopted, the coefficient f1 and the coefficient f2 are to be set to the same function form to prevent divergence of repeated computations of a recursion formula.

The right side of Equation (4) includes the integrated value A (x, y−1, n) of a point P" (x, y−1) at which the horizontal coordinate x is the same as that for the point P (x, y) and the vertical coordinate y is smaller by 1 than that for the point P (x, y). The pixel 3 of the point P" (x, y−1) is charged one row before (previous to) the pixel 3 of the point (x, y), so that the integrated value A (x, y−1, n) of the point P" (x, y−1) can be used at the time of calculating the integrated value A (x, y, n) of the point P (x, y).

More specifically, when y>1, the data correction unit 24 subtracts the second term f1·D (x, y, n) of the Equation (4) from the integrated value A (x, y−1, n) of the point P" (x, y−1) and adds the third term f2·D (x, y−1, n+1) of the Equation (4) to the integrated value A (x, y−1, n) of the point P" (x, y−1). The second term f1·D (x, y, n) is a contribution of the gray scale data D (x, y, n) of the point P (x, y) of the present frame in the integrated value A (x, y−1, n) (see A1 in Equation (1)). The third term f2·D (x, y−1, n+1) is a contribution of the gray scale data D (x, y−1, n+1) of the point P" (x, y−1) of the following frame (see A2 in Equation (1)).

Moreover, when y=1, the integrated value A (x, Y, n−1) at y=Y one frame before can be used instead of the integrated value A (x, y−1, n) of the point P" (x, y−1) to calculate the integrated value A (x, 1, n) in the same manner as the above (see Equation (5), FIG. 7).

According to Equations (4) and (5) as described above, integrated values A (1, y−1, n) to A (X, y−1, n) for one row can be stored in a line memory 45 (FIG. 5) to calculate the integrated value A (x, y, n) in a simple computation successively from y=1, making it possible to suppress an increase in circuit area.

2-2-4. Initial Display Mode

To make it easy to determine the initial value of the recursion formula as described above, an initial display mode is used in which the control circuit 2 causes a black-screen video in which all pixels 3 take a gray scale value "0" to be displayed during a given period (for example, one frame or more) from the time of turning on the power in the display apparatus 1. Below an operation using the initial display mode in the display apparatus 1 is described.

At the time of activating the display apparatus 1, a clear determination unit 46 (FIG. 5) in the Csd correction circuit 4 generates a clear signal to erase information stored in the line memory 45. Initial values "0" are set to the line memory 45.

In the display apparatus 1, the control circuit 2 (FIG. 1) operates in the initial display mode for a given period (one frame or more, for example) from the time of turning on the power. In the initial display mode, regardless of an external video signal, the control circuit 2 generates video data in which all gray scale data have the gray scale value "0" to input the generated result into the data correction unit 24.

In the present embodiment, each of the coefficient multiplying units 41 and 42 in the data correction unit 24 outputs data for an output value "0" based on an input value "0". Moreover, each of the function computation units 49 and 50 outputs the output value "0" based on the input value "0". As a result of the above, gray scale data output by the data correction unit 24 while the initial display mode continues takes the gray scale value "0", so that the black-screen video is displayed in the display apparatus 1.

When the initial display mode is released, the control circuit 2 operates in a normal display mode and inputs video data according to a video signal from outside into the data correction unit 24. Below, the video data showing the last one frame of black screen when the initial display mode is released is called video data D (1) for n=1. In this case, the gray scale data D (x, y, 1) for n=1 all have the gray scale value "0", while the gray scale data D (x, y, 2) for n=2 have a gray scale value corresponding to a video signal.

In the data correction unit 24, the Csd correction circuit 4 (FIG. 5) executes a computational correction according to Equations (2) to (5), in order, from gray scale data (x, 1, 1) of the first row (y=1) in the video data D (1) for n=1. According to Equation (5), the integrated value A (x, 1, 1) corresponding to gray scale data D (x, 1, 1) of the first row is calculated using the following Equation (11).

$$A(x,1,1)=A(x,Y,0)-f1\cdot D(x,1,1)+f2\cdot D(x,Y,1) \tag{11}$$

In the above Equation (11), the first term A (x, Y, 0) in the right side is an integrated value of each gray scale data D (x, y, 1) for n=1 (see A2 in FIG. 7), corresponding to the initial value "0" of the line memory 45. Moreover, the second term and the third term in the right side also take "0", resulting in the integrated value A (x, 1, 1)=0 at n=1 and y=1. In this case, the correction amount ΔD (x,1, 1)=0, resulting in the corrected gray scale data O (x, 1, 1)=0. In the line memory 45, after the integrated value A (x, Y, 0) (=0) is read out, writing of a new integrated value A (x, 1, 1) (=0) is performed.

Next, correctional computation of gray scale data D (x, 2, 1) of the second row (y=2) in video data D (1) for n=1 is executed. According to Equation (4), the integrated value A (x, 2, 1) corresponding to gray scale data D (x, 2, 1) of second row is calculated with the following Equation (12).

$$A(x,2,1)=A(x,1,1)-f1\cdot D(x,2,1)+f2\cdot D(x,1,2) \tag{12}$$

In the above Equation (12), while the first term and the second term in the right side take "0" in the same manner as the case of the first row, the third term in the above Equation (12) has a value based on the gray scale data D (x, 1, 2) in the normal display mode. Thus, the integrated value A (x, 2, 1) with n=1 and y=2 is easily calculated using a computation of the third term in the above Equation (12).

The Csd correction circuit 4 determines a correction amount ΔD (x, 2, 1) based on the calculation result of the integrated value A (x, 2, 1) as described above and calculates the corrected gray scale data O (x, 2, 1). In the line memory 45, a new integrated value A (x, 2, 1) is written after the integrated value A (x, 1, 1) (=0) is read out. The written integrated value A (x, 2, 1) is used for correctional computation of the gray scale data D (x, 3, 1) with y=3. Correctional computation for y=3 and beyond and for the succeeding frames is also executed in the same manner as that described above.

3. Summary

As described above, a display apparatus 1 according to the present embodiment comprises a plurality of pixels 3, a plurality of gate lines GL, a plurality of source lines SL and a control circuit 2. The plurality of pixels 3 are arranged in a matrix. The plurality of gate lines GL is connected to the group of pixels 3 lined up in a row direction of the matrix of pixels 3 and select, in order, a group of pixels 3 in each row at a given frame period T1. The plurality of source lines SL is connected to the group of pixels 3 lined up in a column direction of the matrix of pixels 3 and supply a voltage according to a given gray scale to a group of pixels 3 in the selected row. The control circuit 2 controls, based on gray scale data D (x, y, n) indicating gray scales included in one frame of video, a timing to cause a group of pixels 3 in each row in order to display gray scales for one row in the video. The control circuit 2 corrects, at the data correction unit 24 with a target pixel 3 for display (point P (x, y)) as a reference, gray scale data D (x, y, n) indicating the gray scale to be displayed by the target pixel 3, based on an integrated value A (x, y, n) indicating an integration of a voltage applied to a source line SL (x) connected to the target pixel 3 in a period Tp corresponding to one frame in future time.

In the data correction unit 24, the control circuit 2 can correct, with the target pixel 3 for display (point P (x, y)) as a reference, gray scale data D (x, y, n) indicating the gray scale to be displayed by the target pixel 3, based on an integrated value A (x, y, n) indicating a sum of gray scale data indicating gray scales to be displayed by other pixels 3 connected to the same source line as the target pixel 3 in a period corresponding to one frame in future time. In this case, the coefficients f1 and f2 in the Csd correction circuit 4 do not include a component for converting gray scale data to a voltage and the functions f3 and f4 do not include components for converting a voltage to gray scale data. The output values of the coefficient multiplying units 41 and 42, or, in other words, the multiplied value f1·D (x, y, n) and the multiplied value f2·D (x, y, n+1), are to be gray scale data to which a coefficient for taking into account dispersion (more specifically, difference of time constants at each position within the display surface) within the display surface is multiplied.

According to the above-described display apparatus 1, with the pixel 3 at point P (x, y) as a reference, gray scale data D (x, y, n) for this pixel 3 is corrected in accordance with a sum of gray scale data for a source line SL (x) during one frame in future time or an integration of a voltage at a source line SL (x) during one frame in future time. In this way, it is possible to suppress an effect of a Csd parasitic capacitance such as a vertical shadow or gray scale inclination when displaying a video on the display apparatus 1.

According to the present embodiment, (the data correction unit 24 of) the control circuit 2 calculates an integrated value A (x, y, n) based on gray scale data D (x, y+1, n) to gray scale data D (x, y−1, n+1) that indicate gray scales to be displayed by other pixels 3 connected to the same source line SL (x) as the target pixel 3 for display (Equation (1)). In this way, it is possible to determine an integrated value A (x, y, n) for suppressing an effect of a Csd parasitic capacitance based on the gray scale data D (x, y+1, n) to gray scale data D (x, y−1, n+1).

Moreover, in the present embodiment, the control circuit 2 uses a calculation result of an integrated value A (x, y−1, n) on a pixel 3 for which gray scale data D (x, y−1, n) has been corrected, for calculating an integrated value A (x, y, n) on a pixel 3 of the following row, based on recursion formulas (4) and (5), which is connected to the same source line SL (x) as this pixel 3. In this way, the integrated value A (x, y, n) can be efficiently calculated, making it possible to make it easy to realize Csd correction.

Moreover, in the present embodiment, the data correction unit 24 of the control circuit 2 calculates an integrated value A (x, y, n) based on gray scale data D (x, y+1, n) to gray scale data D (x, y−1, n+1) that indicate gray scales in the n-th frame video and the (n+1)-th frame video and the calculated integrated value A (x, y, n) is used for correction of gray scale data D (x, y, n) indicating a gray scale in the n-th frame video (Equations (3)-(5)). In this way, an integrated value A (x, y, n) based on future video data can be determined, and it is possible to obtain corrected gray scale data O (x, y, n) as a complete solution.

Furthermore, in the present embodiment, the control circuit 2 corrects gray scale data D (x, y, n) using an integrated value A (x+1, y, n) indicating an integration of voltage applied, in a period Tp corresponding to one frame in future time, to a source line SL (x+1) adjacent to the target pixel 3 for display (see f4 in Equation (3)). In this way, it is possible to suppress an effect of a Csd parasitic capacitance due to source lines SL (x), SL (x+1) in the vicinity of the pixel 3.

Moreover, in the present embodiment, a frame period T1 includes a given vertical blanking period T3. The control circuit 2 corrects gray scale data D (x, y, n) based on an effective value A (x, y, n)/(Y−1) of an integrated value in a period Tp corresponding to one frame including the vertical blanking period T3 (Equation (3)). In this way, it is possible to perform Csd correction appropriately in accordance with setting of the vertical blanking period T3.

Embodiment 2

In Embodiment 1, an integrated value based on future video data is determined to perform Csd correction. In Embodiment 2, a display apparatus which approximately determines the integrated value using previous video data to perform Csd correction is described.

1. Overview

Figure 8:
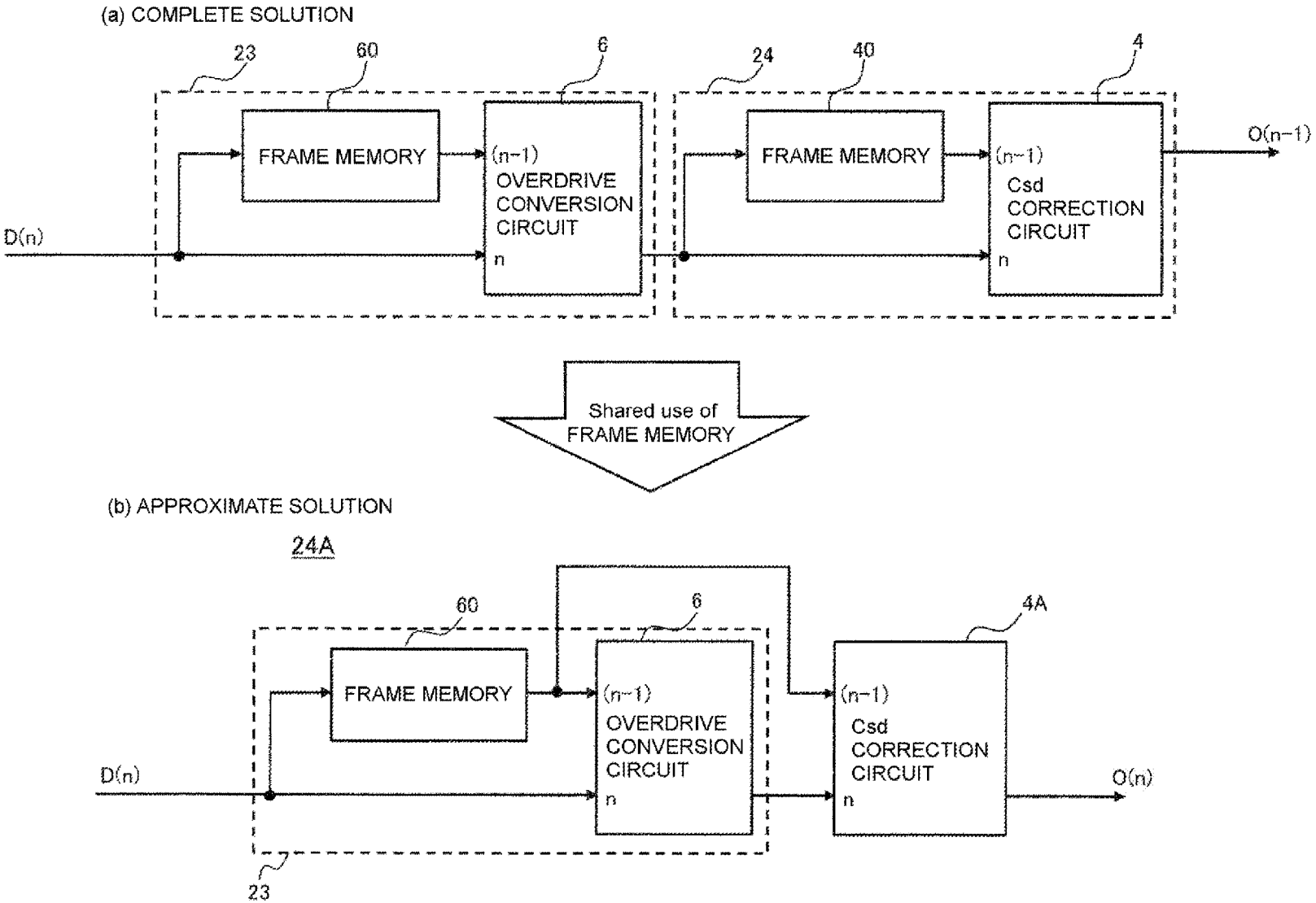
FIG. 8 is a drawing for explaining an overview of the display apparatus according to Embodiment 2.

An overview of the display apparatus according to the present embodiment is described using FIG. 8. FIG. 8 is a drawing for explaining an overview of a data correction unit 24A of the display apparatus 1 according to Embodiment 2.

FIG. 8 (*a*) shows an implementation example of the data correction unit 24 according to Embodiment 1. FIG. 8 (*b*) shows one example (including an overdrive conversion unit 23) of the data correction unit 24A according to Embodiment 2.

As shown in FIG. 8 (*a*), the data correction unit 24 according to Embodiment 1 is implemented at a latter stage of the overdrive conversion unit 23, for example. The overdrive conversion unit 23 comprises a frame memory 60 to store one frame of video data D (n−1) and an overdrive conversion circuit 6 to perform an overdrive conversion. In the overdrive conversion unit 23, the overdrive conversion on the present frame video data D (n) is performed with reference to the previous video data D (n−1) for one frame which passed through the frame memory 60.

On the other hand, Csd correction in the data correction unit 24 of the Embodiment 1 handles video data D (n−1) which passed through the frame memory 40 as the present video data and is executed with reference to future video data D(n) for one frame which do not pass through the frame memory 40. Therefore, video data referred to are different frames between the data correction unit 24 and the overdrive conversion unit 23 of Embodiment 1, so that different frame memories 40 and 60 are required. Moreover, in the data correction unit 24 of the Embodiment 1, since the video data D (n−1) which passed through the frame memory 40 is handled as the present video data, a frame delay in the video display can occur.

Then, in the Csd correction circuit 4A of the data correction unit 24A in the present embodiment, Csd correction similar to that in Embodiment 1 is performed approximately using previous video data D (n−1). In this way, as shown in FIG. 8 (*b*), use of the frame memory 60 can be shared between the Csd correction circuit 4A and the overdrive conversion circuit 6 to reduce the circuit size. Moreover, a frame delay in the video display of the display apparatus 1 can be avoided. The data correction unit 24A according to the present embodiment comprises an overdrive conversion unit 23 together with a Csd correction circuit 4A. Below details of the data correction unit 24A according to the present embodiment are described.

2. Detail

Figure 9:
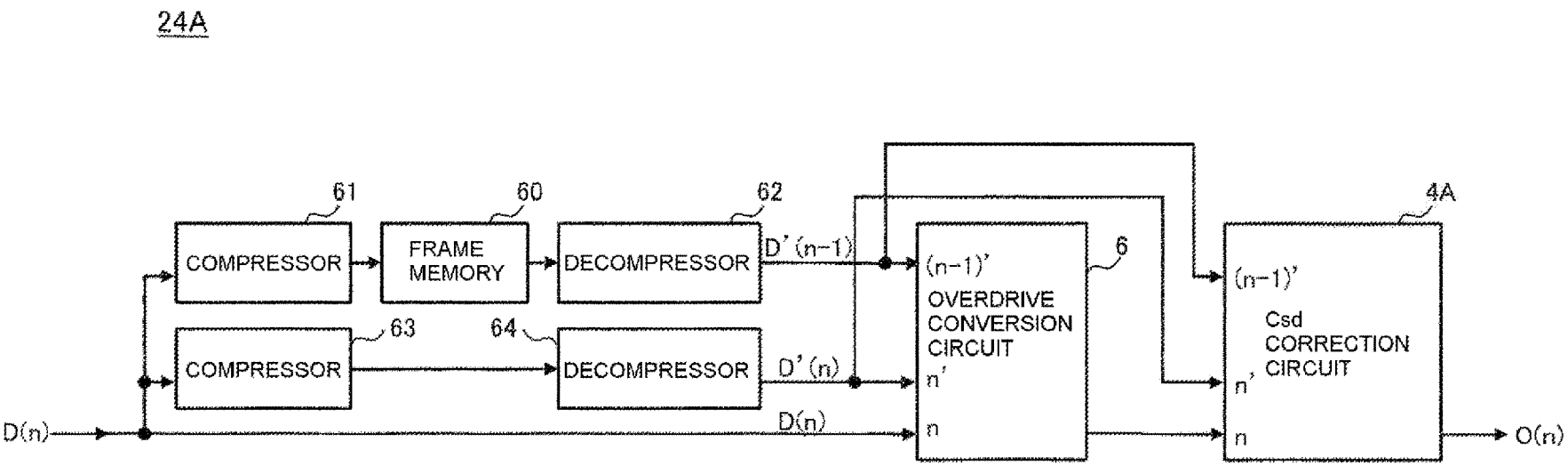
FIG. 9 shows a block diagram of an exemplary configuration of a data correction unit according to Embodiment 2.

FIG. 9 shows a block diagram showing an exemplary configuration of the data correction unit 24A according to the present embodiment. In the present example, the data correction unit 24A comprises a Csd correction circuit 4A, an overdrive conversion circuit 6 corresponding to the above-described overdrive conversion unit 23, a frame memory 60, compressors 61 and 63, and decompressors 62 and 64. In the data correction unit 24A according to the present embodiment, as described above, the Csd correction circuit 4A and the overdrive conversion circuit 6 make shared use of the frame memory 60. Moreover, in the example in FIG. 9, compression and decompression of video data D (n) are performed as a more practical example.

More specifically, the compressor 61 compresses video data D(n) using a given computational expression to record the compressed result in the frame memory 60. The decompressor 62 reads out video data compressed and recorded in the frame memory 60 and decompresses the read out result using a computational expression corresponding to the above-mentioned computational expression to output the obtained previous video data D' (n−1) to the overdrive conversion circuit 6. In this way, the circuit size of the frame memory 60 can be reduced.

Moreover, the compressor 63 compresses the present frame video data D (n) using the same computational expression as the compressor 61, for example. The decompressor 64 decompresses the compressed present frame video data D (n) using the same computational expression as that for the decompressor 62, for example, to output the obtained present video data D' (n) to the overdrive conversion circuit 6.

The overdrive conversion circuit 6 refers to video data D' (n) and D' (n−1) after compression and decompression of each frame to perform overdrive conversion on uncompressed present frame video data D (n). In this way, degradation of the display quality due to data compression can be suppressed in the overdrive conversion.

In the same manner as the above-described overdrive conversion circuit 6, the Csd correction circuit 4A according to the present embodiment refers to video data D' (n) and D' (n−1) of each frame after compression and decompression to execute Csd correction on the present frame video data D (n). In this way, degradation of the display quality due to data compression can be suppressed even in the Csd correction.

Figure 10:
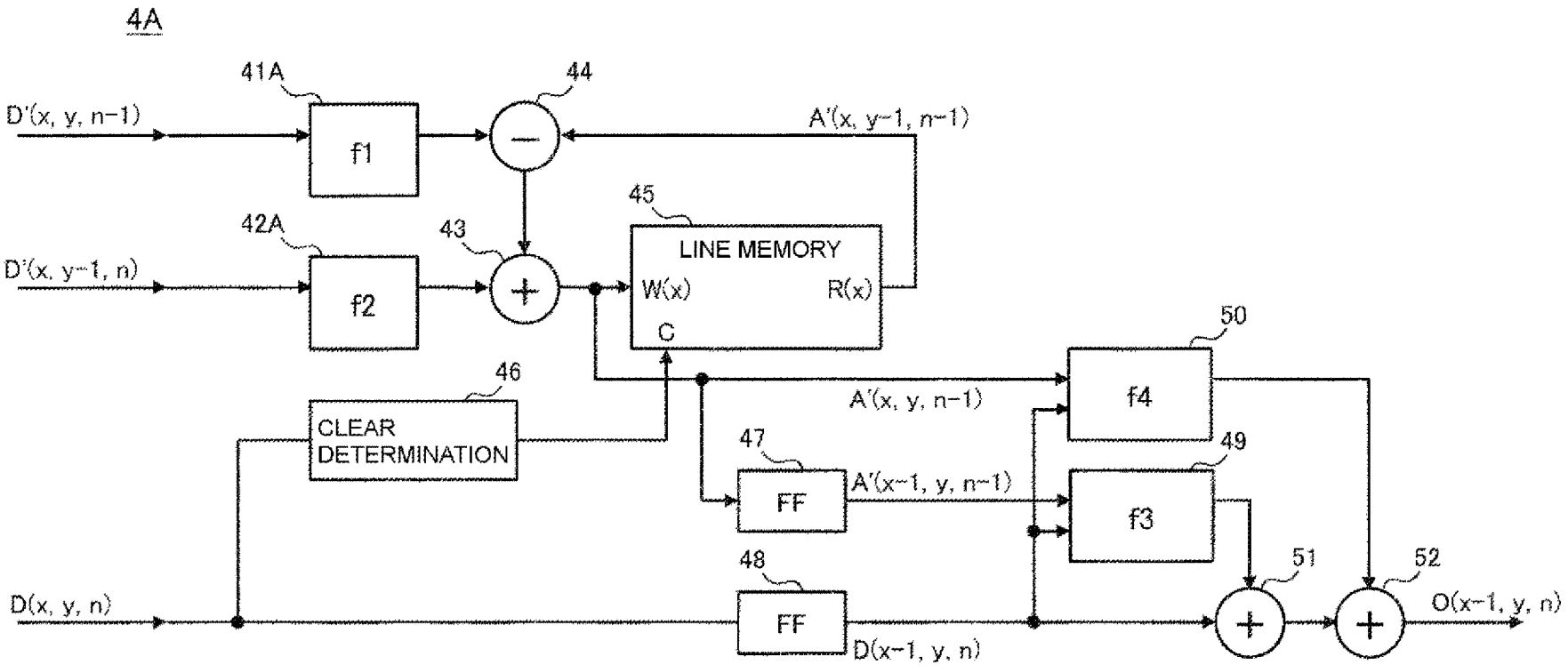
FIG. 10 shows a block diagram of an exemplary configuration of a Csd correction circuit according to Embodiment 2.

FIG. 10 shows a block diagram of an exemplary configuration of the Csd correction circuit 4A according to the present embodiment.

In the same configuration as the Csd correction circuit 4 (FIG. 5) according to Embodiment 1, the Csd correction circuit 4A exemplified in FIG. 10 inputs previous gray scale data D' (x, y, n−1) into the coefficient multiplying unit 41A and present gray scale data D' (x, y−1, n) into the coefficient multiplying unit 42A. Each of the gray scale data D' (x, y, n−1) and gray scale data D' (x, y−1, n) are respectively included in the compressed and decompressed video data D' (n−1) and D' (n).

According to the Csd correction circuit 4A of the present example, a computational correction based on the below-described Equations (21)-(23) is realized.

[Mathematical expression 3]

$$\Delta D(x, y, n-1) = f_3\left(D(x, y, n), \frac{A'(x, y, n-1)}{Y-1}\right) + f_4\left(D(x, y, n), \frac{A'(x+1, y, n-1)}{Y-1}\right) \tag{21}$$

$$A'(x, y, n-1) = A'(x, y-1, n-1) - f_1 \cdot D'(x, y, n-1) + f_2 \cdot D'(x, y-1, n) \tag{22}$$

$$A'(x, 1, n-1) = A'(x, Y, n-2) - f_1 \cdot D'(x, 1, n-1) + f_2 \cdot D'(x, Y, n-1) \tag{23}$$

Equation (21) is a computational expression for correction amount ΔD (x, y, n) in the present embodiment. Equations (22) and (23) are recursive formulas for determining integrated value A' (x, y, n−1) in the present embodiment.

For the correction amount ΔD (x, y, n) in Embodiment 1, the integrated value A (x, y, n) of the future gray scale data D (x, y, n) after the present time is used as arguments of functions f3 and f4 as shown in Equation (3). For the correction amount ΔD (x, y, n) in the present embodiment, instead of the above-mentioned integrated value A (x, y, n), the integrated value A' (x, y, n−1) from the time of one frame before is used as shown in Equation (21).

Moreover, the integrated value A' (x, y, n−1) in the present embodiment is obtained by integrating the compressed and decompressed gray scale data D' (x, y, n−1) and D' (x, y, n) in the same manner as in Embodiment 1 (see Equation (1)). While the frame number n is shifted in Equations (22) and (23), the recursive formula format for the integrated value A' (x, y, n−1) is the same as that for Embodiment 1 (see Equations (4) and (5)).

Moreover, when starting Csd correction in the Csd correction circuit 4A based on Equations (22) and (23), the initial display mode can be used in the same manner as for Embodiment 1, for example.

As described above, in the present embodiment, the Csd correction of each gray scale data D (x, y, n) is performed using the integrated value A' (x, y, n−1) from the time of one frame before as an approximated value of an integrated value indicating an integration of voltages applied to the source line SL during a period corresponding to one frame in future time. In other words, while an error such that the correction amount ΔD (x, y, n) delays by one frame relative to Embodiment 1 can occur, it is considered that there be particularly no difficulty practically with such an error from a point of view below.

In other words, when a still picture is displayed on the display apparatus 1, for example, such an error as described above does not occur, so that Csd correction of each gray scale data D (x, y, n) can be appropriately performed. Moreover, even with a moving picture, reflection of a gray scale output from the control circuit 2 takes time depending on the response speed of the liquid-crystal capacitance Clc in the pixel 3. Moreover, in a case of a moving picture relative to a still picture, the identification accuracy of luminance and chromaticity generally decreases for the human eye. Normally, the effect of the Csd parasitic capacitance is small such that the error as described above can be neglected.

Moreover, from the same point of view as described above, even when compressed and decompressed gray scale data D' (x, y, n−1) and D' (x, y, n) are used in Csd correction, the effect of the Csd parasitic capacitance can practically be suppressed with sufficient accuracy.

3. Summary

As described above, in the display apparatus 1 according to the present embodiment, the data correction unit 24A of the control circuit 2 calculates an integrated value A (x, y, n−1) based on the gray scale data D (x, y+1, n−1) to D (x, y−1, n) indicating the gray scales in the (n−1)-th frame video and the n-th frame video and uses the calculated integrated value A (x, y, n−1) for correction of gray scale data D (x, y, n) indicating a gray scale in the n-th frame video. In this way, a future integrated value for Csd correction can be determined approximately from the previous gray scale data D (x, y+1, n) to D (x, y−1, n), and it is possible to avoid a frame delay due to Csd correction.

In the present embodiment, the display apparatus 1 further comprises a frame memory 60 to store the (n−1)-th frame video data D (n−1). In the overdrive conversion circuit 6, the control circuit 2 refers to video data D (n−1) stored in the frame memory 60 to perform a given overdrive conversion on the n-th frame video data D (n). In the Csd correction circuit 4A, the control circuit 2 refers to the video data D (n−1) stored in the frame memory 60 to calculate the integrated value A (x, y, n−1) and uses the calculated integrated value A (x, y, n−1) for correction of the gray scale data D (x, y, n). In this way, use of the frame memory 60 can be shared between the overdrive conversion and the Csd correction and it is possible to suppress an increase in circuit area due to Csd correction.

Moreover, in the present embodiment, the frame memory 60 stores compressed frame video data D (n−1). The control circuit 2 calculates an integrated value A' (x, y, n−1) based on data D' (n−1) obtained by decompressing video data stored in the frame memory 60 and data D' (n) obtained by decompressing data obtained by compressing the n-th frame video data D (n), and the calculated integrated value A' (x, y, n−1) is used for correcting the gray scale data D (x, y, n). In this way, it is possible to suppress an effect of the Csd parasitic capacitance accurately while reducing the circuit size of the frame memory 60.

While specific embodiments and variations of the present invention have been described as in the above, it is to be construed that the present invention be not limited to the above-mentioned embodiments and variations, so that various changes can be made within the scope of the present invention. For example, what are in the individual embodiments can be combined as needed to make the combined result as one embodiment of the present invention.

The invention claimed is:

1. A display apparatus comprising:

a plurality of pixels arranged in a matrix;

a plurality of gate lines connected to a group of pixels lined up in a row direction of the matrix of pixels to select, in order, a group of pixels in each row at a given frame period;

a plurality of source lines connected to a group of pixels lined up in a column direction of the matrix of pixels to supply a voltage according to a given gray scale to a group of pixels in the row being selected; and a control unit to control, based on gray scale data indicating gray scales included in one frame of video, a timing to cause a group of pixels in each row to display, in order, gray scales for one row in the video, wherein the control unit corrects gray scale data indicating a gray scale to be displayed by a target pixel, based on a first integrated value indicating an integration of voltage applied to a source line connected to the target pixel in a period corresponding to one frame in future time from a time of charging for the target pixel or a sum of gray scale data indicating gray scales to be displayed by other pixels connected to the same source line as the target pixel in a period corresponding to one frame in future time from the time of charging for the target pixel, and the control unit calculates, based on gray scale data indicating gray scales in a (n−1)-th frame video and a n-th frame video, a second integrated value indicating an integration of voltage applied to a source line connected to the target pixel in a period corresponding to one frame or a sum of gray scale data indicating gray scales to be displayed by other pixels connected to the same source line as the target pixel in a period corresponding to one frame and approximately uses the second integrated value as the first integrated value for correction of gray scale data indicating a gray scale, in the n-th frame video, to be displayed by the target pixel for display.

2. The display apparatus according to claim 1, wherein the control unit calculates the second integrated value based on the gray scale data indicating the gray scales to be displayed by other pixels connected to the same source line as the target pixel for display.

3. The display apparatus according to claim 2, wherein the control unit uses a calculation result of the second integrated value on a pixel, for which the gray scale data has been corrected, for calculating the second integrated value on a pixel in a following row based on a given recursion formula, the pixel in the following low being connected to the same source line as the pixel for which the gray scale data has been corrected.

4. The display apparatus according to claim 1, further comprising a frame memory to store (n−1)-th frame video data, wherein the control unit refers to video data stored in the frame memory to perform an overdrive conversion, in which an overshoot drive is performed on a pixel in the matrix, on n-th frame video data; and refers to video data stored in the frame memory to calculate the second integrated value based on gray scale data indicating gray scales in the n-th frame video and the (n−1)-th frame video and uses the second integrated value for correction of gray scale data indicating a gray scale, in the n-th frame video, to be displayed by the target pixel for display, and the frame memory is shared between the overdrive conversion and the correction of gray scale data.

5. The display apparatus according to claim 4, wherein the frame memory stores compressed video data; and the control unit calculates the second integrated value based on data obtained by decompressing video data stored in the frame memory and data obtained by decompressing data obtained by compressing the n-th frame video data, and uses the second integrated value for correcting gray scale data indicating a gray scale to be displayed by the target pixel for display.

6. The display apparatus according to claim 1, wherein the control unit corrects gray scale data, that indicates a gray scale to be displayed by the target pixel for display, using an integrated value indicating an integration of voltage applied, in the period corresponding to one frame in future time, to a source line adjacent to the target pixel for display.

7. The display apparatus according to claim 1, wherein the given frame period comprises a given vertical blanking period; and the control unit corrects gray scale data, that indicates a gray scale to be displayed by the target pixel for display, based on an effective value of an integrated value in a period corresponding to one frame including the vertical blanking period.

8. The display apparatus according to claim 1, wherein the control unit comprises a line memory to store the second integrated value corresponding to one row.

9. The display apparatus according to claim 8, wherein in a given period after a time of turning on a power in the display apparatus, the control unit generates video data causing all pixels to take a gray scale value "0", and sets initial values "0" to the line memory.

10. A display apparatus comprising:

a plurality of pixels arranged in a matrix;

a plurality of gate lines connected to a group of pixels lined up in a row direction of the matrix of pixels to select, in order, a group of pixels in each row at a given frame period;

a plurality of source lines connected to a group of pixels lined up in a column direction of the matrix of pixels to supply a voltage according to a given gray scale to a group of pixels in the row being selected;

a control unit to control, based on gray scale data indicating gray scales included in one frame of video, a timing to cause a group of pixels in each row to display, in order, gray scales for one row in the video; and a frame memory to store (n−1)-th frame video data, wherein the control unit corrects gray scale data indicating a gray scale to be displayed by a target pixel, based on an integrated value indicating an integration of voltage applied to a source line connected to the target pixel in a period corresponding to one frame in future time from a time of charging for the target pixel or a sum of gray scale data indicating gray scales to be displayed by other pixels connected to the same source line as the target pixel in a period corresponding to one frame in future time from the time of charging for the target pixel;

refers to video data stored in the frame memory to perform an overdrive conversion, in which an overshoot drive is performed on a pixel in the matrix, on n-th frame video data; and refers to video data stored in the frame memory to calculate an integrated value based on gray scale data indicating gray scales in the n-th frame video and the (n−1)-th frame video and uses a calculated integrated value for correction of gray scale data indicating a gray scale, in the n-th frame video, to be displayed by the target pixel for display, and the frame memory is shared between the overdrive conversion and the correction of gray scale data.

* * * * *